US009962729B2

(12) United States Patent
Dellea et al.

(10) Patent No.: US 9,962,729 B2
(45) Date of Patent: May 8, 2018

(54) INSTALLATION AND METHOD WITH IMPROVED PERFORMANCE FOR FORMING A COMPACT FILM OF PARTICLES ON THE SURFACE OF A CARRIER FLUID

(71) Applicant: COMMISSARIAT A L'ENERGIE ATOMIQUE ET AUX ENERGIES ALTERNATIVES, Paris (FR)

(72) Inventors: Olivier Dellea, La Talaudiere (FR); Pascal Fugier, Bernin (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 206 days.

(21) Appl. No.: 15/027,336

(22) PCT Filed: Oct. 9, 2014

(86) PCT No.: PCT/EP2014/071623

§ 371 (c)(1),
(2) Date: Apr. 5, 2016

(87) PCT Pub. No.: WO2015/052275

PCT Pub. Date: Apr. 16, 2015

(65) Prior Publication Data

US 2016/0236237 A1 Aug. 18, 2016

(30) Foreign Application Priority Data

Oct. 11, 2013 (FR) ..... 13 59922

(51) Int. Cl.

| | |
|---|---|
| ***B05D 1/36*** | (2006.01) |
| ***B05D 1/20*** | (2006.01) |
| *B05D 5/08* | (2006.01) |

(52) U.S. Cl.
CPC ..... *B05D 1/204* (2013.01); *B05D 5/08* (2013.01); *B05D 2518/10* (2013.01)

(58) Field of Classification Search
CPC ..... B05D 1/36; B05D 1/20
See application file for complete search history.

(56) References Cited

U.S. PATENT DOCUMENTS

| | | |
|---|---|---|
| 9,097,599 B2 | 8/2015 | Phan et al. |
| 2005/0129867 A1 | 6/2005 | Picard et al. |

(Continued)

FOREIGN PATENT DOCUMENTS

| | | |
|---|---|---|
| WO | 2008/014604 A1 | 2/2008 |
| WO | 2012/113745 A1 | 8/2012 |
| WO | 2013/007718 A1 | 1/2013 |

OTHER PUBLICATIONS

International Search Report dated Dec. 23, 2014 in PCT/EP2014/071623 Filed Oct. 9, 2014.

(Continued)

*Primary Examiner* — Xiao S Zhao
(74) *Attorney, Agent, or Firm* — Oblon, McClelland, Maier & Neustadt, L.L.P.

(57) ABSTRACT

An installation for forming a compact film of particles on a surface of a carrier fluid, including a zone acting as a reservoir of carrier fluid, an inclined ramp, a particle storage and transfer zone, a mechanism moving the carrier fluid, a mechanism for dispensing the particles in solution, configured to dispense the particles on the surface of the carrier fluid in the zone acting as a reservoir, and a structure for deflecting the particles configured to favor, along a transverse direction of the installation, spreading of the particles at the outlet of the zone acting as a reservoir. The structure for deflecting particles is permeable to the carrier fluid.

19 Claims, 9 Drawing Sheets

(56) References Cited

U.S. PATENT DOCUMENTS

| | | | |
|---|---|---|---|
| 2007/0231498 | A1 | 10/2007 | Picard et al. |
| 2011/0135834 | A1 | 6/2011 | Schneider et al. |
| 2013/0330471 | A1 | 12/2013 | Dellea et al. |
| 2014/0147583 | A1 | 5/2014 | Dellea et al. |
| 2014/0158334 | A1 | 6/2014 | Dellea et al. |
| 2014/0356528 | A1 | 12/2014 | Dellea et al. |
| 2014/0374930 | A1 | 12/2014 | Dellea et al. |
| 2015/0010693 | A1 | 1/2015 | Dellea et al. |
| 2015/0044809 | A1 | 2/2015 | Dellea et al. |
| 2015/0217328 | A1 | 8/2015 | Dellea et al. |

OTHER PUBLICATIONS

French Search Report dated Jul. 3, 2014, in FR 13 59922 Filed Oct. 11, 2013.
U.S. Appl. No. 14/890,061, filed Nov. 9, 2015, Dellea, et al.
U.S. Appl. No. 14/890,857, filed Nov. 12, 2015, Dellea, et al.

INSTALLATION AND METHOD WITH IMPROVED PERFORMANCE FOR FORMING A COMPACT FILM OF PARTICLES ON THE SURFACE OF A CARRIER FLUID

FIELD OF THE INVENTION

The invention relates to the field of installations and methods for forming a compact film of particles on the surface of a carrier fluid, the compact film obtained being generally intended to be deposited on a substrate, which is preferably conveyed.

More specifically, the invention relates to the formation of a compact film of particles, also known as a film of organised particles, preferably of the monolayer type and wherein the particle size may be between a few nanometers and several hundred micrometers. The particles, preferably spherical in shape, may for example be silica particles.

The invention relates to the formation of simple compact films, or to the formation of structured compact films, this structuring being intended to format the film in order for example to integrate further particles, and/or objects, therein. A further possibility consists of providing zones emptied of particles, surrounded by the film which remains organised. In the case of the integration of objects in the film, it particularly consists of manufacturing devices of a hybrid nature, such as for example sensors. As an indication, a hybrid device associates by definition on the same substrate objects having various functions, for example electronic, optical, electro-optical, piezo-electric, thermoelectric, mechanical, etc.

The objects to be integrated in the film of particles are for example:

- active electronic components, such as transistors, microprocessors, integrated circuits, etc.;
- passive electronic components, such as resistors, capacitors, diodes, photodiodes, coils, conductive tracks, solder preforms, etc.;
- optical components, such as lenses, microlenses, diffraction arrays, filters, etc.;
- batteries, micro-fuel cells, micro-batteries, photo-detectors, solar cells, RFID system, etc.;
- nano or micrometric particles or aggregates, active or passive, for example such as oxides, polymers, metals, semi-conductors, Janus particles (particles with two faces of different natures or properties), nanotubes, etc.

More generally, the invention has applications in numerous fields such as fuel cells, optics, photonics, polymer coating, chips, MEMs, organic electronics and photovoltaics, heat exchangers, sensors, tribology.

STATE OF THE RELATED ART

Numerous techniques are known for the formation and deposition of compact films of particles on a substrate, the latter optionally being conveyed, and flexible or rigid in nature.

As a general rule, a storage and transfer zone supplied with particles, which float on a carrier fluid contained in said zone, is provided. The organised particles in the transfer zone, forming a monolayer of particles or thin film, are pushed by the arrival of other particles and by the flow of the carrier fluid, to an outlet of this zone whereby they reach the substrate. They are then deposited on the conveyed substrate. For this purpose, a capillary bridge usually provides the link between the substrate and the carrier fluid contained in the storage and transfer zone.

Under normal installation operating conditions, in the storage and transfer zone, the particles are kept organised notably due to the pressure exerted upstream by the moving particles intended to subsequently reach this transfer zone. The cohesion of the organisation of the particles is further provided by weak capillary or electrostatic type forces. When the particle transfer zone is connected in the upstream direction to an inclined ramp whereon the particles from a dispensing device are conveyed, the same particles present on the inclined ramp apply a pressure on the particles contained in the transfer zone, and thus enable, in conjunction with the proximity capillary forces, to retain the organisation of the particles in this zone, until deposition on the substrate, by capillarity or direct contact.

In this respect, it is noted that the particle organisation technique using compression is notably known from the document Lucio Isa et al., "Particle Lithography from Colloidal Self-Assembly at Liquid_Liquid Interfaces", acsnano, VOL. 4•NO. 10•5665-5670•2010, from the document Markus Retsch, "Fabrication of Large-Area, Transferable Colloidal Monolayers Utilizing Self-Assembly at the Air/Water Interface", Macromol. Chem. Phys. 2009, 210, 230-241, or from the document Maria Bardosova, "The Langmuir-Blodgett Approach to Making Colloidal Photonic Crystals from Silica Spheres", Adv. Mater. 2010, 22, 3104-3124. The compression technique using an inclined ramp is for its part described more specifically in the document CA 2 695 449. With this specific technique, the kinetic energy associated with the moving particles on the ramp enables same to organise themselves automatically on said ramp, when they impact the particle leading edge, also situated on the inclined ramp. The organisation is thus established on the ramp, and then retained when the organised particles enter the transfer zone, by means of the continuous supply of particles impacting the leading edge.

The kinetic energy required for the self-organisation of the particles is in this case supplied by the inclined ramp transporting the carrier fluid and the particles. In this respect, it is noted that the particles are generally in solution in the dispensing device. The latter is arranged to deliver the particles to the surface of the carrier fluid, at a zone acting as a reservoir positioned upstream from the inclined ramp and communicating with the inlet thereof.

According to the composition of the solution or that of the carrier fluid, these may be non-miscible or very slightly miscible, and the respective surface tensions thereof may also differ. This is notably the case when the solution contains one or a plurality of solvents such as chloroform or n-butanol, wherein the respective surface tensions are 26.67 and 24.93 mN/m at 25° C., and the carrier fluid is deionised water with a surface tension of the order of 72 mN/m at the same temperature.

In this case, when the solution containing the particles is dispensed at the surface of the carrier fluid present in the zone acting as a reservoir, interfacial tension gradients then arise inducing hydrodynamic instabilities, the consequences of which are significant variations of fluid thickness. The convection movements observed under these conditions are known as Marangoni instabilities. These adverse effects are further accentuated when the zone acting as a reservoir is equipped with a particle deflector arranged through this zone, and the function whereof is that of providing transverse spreading of the particles at the outlet of the zone acting as a reservoir.

This non-linear Marangoni instability phenomenon may be the source of dewetting of the inclined ramp. Indeed, in particular when the injection rate of the solution containing the particles exceeds a certain threshold, dry zones may appear on the inclined ramp, which is however supposed to be entirely wetted by the mixture of carrier fluid and solution. These dry zones, directly induced by the hydrodynamic instabilities observed upstream in the zone acting as a reservoir, thus disrupt long-term the laminar flow of the carrier fluid on the inclined ramp. Consequently, the organisation of the particles in the storage and transfer zone may be profoundly altered.

This phenomenon is all the more accentuated as the flow rate of particles in solution increases. This observation is problematic as increasing the flow rate of particles enables the acceleration of the substrate pull rate, and thus an increase in output. In addition, there is a need for optimising the installations and methods described above, in particular for the high-speed deposition of compact films on conveyed substrates.

DESCRIPTION OF THE INVENTION

The aim of the invention is thus that of at least partially addressing the need identified above. For this purpose, the invention firstly relates to an installation for forming a compact film of particles on the surface of a carrier fluid, the installation including:

- a zone acting as a carrier fluid reservoir;
- an inclined ramp situated extending from the zone acting as a reservoir and whereon the particles are intended to circulate gravitationally;
- a particle storage and transfer zone situated extending from the inclined ramp;
- means for moving the carrier fluid intended to make it circulate from the zone acting as a reservoir to the particle storage and transfer zone, via the inclined ramp;
- means for dispensing the particles in solution, configured to dispense said particles on the surface of the carrier fluid in the zone acting as a reservoir; and
- a structure for deflecting particles, passing through the surface of the carrier fluid into the zone acting as a reservoir, said structure being arranged downstream from said means for dispensing particles along the main flow direction of the carrier fluid from the zone acting as a reservoir to the particle storage and transfer zone, via the inclined ramp, said structure being configured to favour, along the transverse direction of the installation parallel with the surface of the carrier fluid and orthogonal to a main flow direction, spreading of the particles at the outlet of the zone acting as a reservoir.

According to the invention, said structure for deflecting particles is permeable to the carrier fluid. In addition, the structure specific to the invention makes it possible to divide, distribute and slow down the progression of Marangoni disruptions.

This advantageously makes it possible to increase the particle flow rate and accelerate the substrate pull rate, while limiting the risks of lack of particle organisation in the storage and transfer zone. In other words, the installation according to the invention makes it possible to remove/limit the risks of dry zones on the inclined ramp, while operating with high yields.

The invention includes at least one of the following optional features, taken in isolation or in combination.

Said structure for deflecting particles has, in alternation, along same between a first end and a second opposite end in said transverse direction, obstacles and spaces allowing the passage of the carrier fluid.

Said obstacles are rods, for example screw rods screwed onto a support plate. The obstacles could nonetheless have any other overall shape, without leaving the scope of the invention. This could for example consist of an overall conical, pyramidal or tubular shape.

Said obstacles are fitted with an interval of approximately 1 to 10 mm, preferably 5 mm, and the structure for deflecting particles is embodied so as to have, on the surface of the carrier fluid, an open area ratio of 0.05 to 0.9, preferably approximately 0.5.

The obstacles are made of hydrophobic, superhydrophobic or hydrophilic material, for example metallic material.

The obstacles have a width between 1 and 9.5 mm.

The structure for deflecting particles extends all along the carrier fluid, along said transverse direction of the installation.

The structure for deflecting particles has an overall shape defining at least one convex portion viewed from an outlet of said zone acting as a reservoir. The means for dispensing particles on the surface of the carrier fluid are preferably arranged in the vicinity of this convex portion.

The structure for deflecting particles has a parabolic, circular, V-shaped or sinusoidal overall shape.

The zone acting as a reservoir includes, downstream from the structure for deflecting particles, at least one compartment defined by a wall permeable to the carrier fluid, the surface whereof is traversed by said wall. This makes it possible to impede the propagation of the hydrodynamic instabilities.

Said wall is embodied by alternating obstacles and spaces allowing the passage of the carrier fluid. This embodiment is thus substantially identical to that of the structure for deflecting particles. In addition, all the optional features described in relation with this structure are also applicable to the walls of the compartments. Nevertheless, it is noted that the particles floating on the surface of the carrier fluid are intended to pass through these walls to temporarily enter inside the compartments, while they are not intended to pass through the deflecting structure downstream whereof these particles are dispensed.

Each compartment has, on the surface of the carrier fluid, a surface area between 0.5 and several hundred $cm^2$, for example 1000 $cm^2$, and more preferentially between 2 and 500 $cm^2$.

The installation includes a substrate for depositing the compact film of particles, said substrate facing an outlet of particles from said storage and transfer zone. It is configured to carry out deposition of the compact film of particles on a conveyed substrate, said substrate being flexible or rigid.

According to a further aspect of the invention, it further comprises, arranged at a junction between the zone acting as a reservoir and the inclined ramp, means for raising the level of the carrier fluid by the capillary effect. In other words, the invention envisages means for locally raising the level of the carrier fluid immediately prior to the entry thereof onto the inclined ramp, by means of a capillary effect compensating for the weight of this carrier fluid. This technique makes it possible to reduce the fluid thickness variation phenomenon, resulting from the interfacial tension gradients between the carrier fluid and the solution containing the particles. By reducing the consequences of these hydrodynamic instabilities at the inlet of the inclined ramp, the risks of dewetting thereof are reduced extensively. In other words, the purpose of the raising means is that of increasing the level of the carrier fluid and thus distancing the instabilities from the bottom, and thus modifying the lines of the flow of the carrier fluid so as to favour spreading along the width.

This advantageously makes it possible to increase the particle flow rate further and accelerate the substrate pull rate, while limiting the risks of lack of particle organisation in the storage and transfer zone. In other words, this makes it possible to remove/limit dry zones on the inclined ramp, while operating with high yields.

The invention also includes at least one of the following optional features, taken in isolation or in combination.

Said means for raising the level of carrier fluid by the capillary effect consist of a barrier of contacts spaced out from one another.

These raising means may be supplemented by a second barrier of contacts offset with respect to the first, along the main fluid flow direction.

The raising means may be positioned by suspension from a part, itself emerged from the flow, via a comb for example. In addition, the contacts do not necessarily touch the bottom of the zone acting as a reservoir.

Said contacts are fitted with an interval of approximately 2 to 4 mm. They have an overall conical, pyramidal or tubular shape. Further shapes may nonetheless be envisaged, notably a cylindrical shape, with a cross-section that can be square, triangular, polygonal or a variable cross-section along the height of the contact.

The contacts are made of hydrophobic material, for example silicone.

The contacts have a ratio between the height and maximum width thereof between 1 and 30.

The contacts have a base approximately 2 mm in width and between 2 and 3 mm in height.

Said means for raising the level of the carrier fluid by the capillary effect extend all along the carrier fluid, along the transverse direction of the installation parallel with the surface of the carrier fluid and orthogonal to the main flow direction of the carrier fluid from the zone acting as a reservoir to the particle storage and transfer zone, via the inclined ramp.

The installation includes a substrate for depositing the compact film of particles, said substrate facing an outlet of particles from said storage and transfer zone.

The installation is configured to carry out deposition of the compact film of particles on a conveyed substrate, said substrate being flexible or rigid.

The invention also relates to a method for forming a compact film of particles on the surface of a carrier fluid, using an installation as described above, the method comprising a step for moving the carrier fluid so as to make it circulate from the zone acting as a reservoir to the particle storage and transfer zone, via the inclined ramp, and a step for dispensing the particles in solution on the surface of the moving carrier fluid, in the zone acting as a reservoir, said step for moving the carrier fluid being carried out so as to make the carrier fluid circulate through said permeable structure for deflecting particles, arranged upstream from said means for dispensing said particles.

Preferably, the method is used for forming a compact film of particles having a large size between 1 nm et 500 μm. By way of illustrative examples, the particles/colloids used may be of the oxide ($SiO_2$, ZnO, $Al_2O_3$, etc.), polymer (latex, PMMA, polystyrene, etc.) or metal (Au, Cu, alloys, etc.) particle type. Although the particle size range is preferentially between 1 nm and 500 μm, it is also possible to use glass fibres, for example 10 μm in diameter, and having lengths ranging from 10 to 4000 μm, provided that they are less than the distance separating two contacts. Further particles such as silicon or graphene layers may also be envisaged, without leaving the scope of the invention.

Preferably, the carrier fluid is deionised water, and said particles are found in solution in a solvent having a surface tension less than that of deionised water, said solvent being preferably n-butanol, methanol, chloroform, or a mixture of at least two thereof.

Further advantages and features of the invention will emerge in the non-limiting detailed description hereinafter.

BRIEF DESCRIPTION OF THE FIGURES

This description will be made with reference to the appended figures wherein.

DETAILED DESCRIPTION OF PREFERRED EMBODIMENTS

Figure 1:
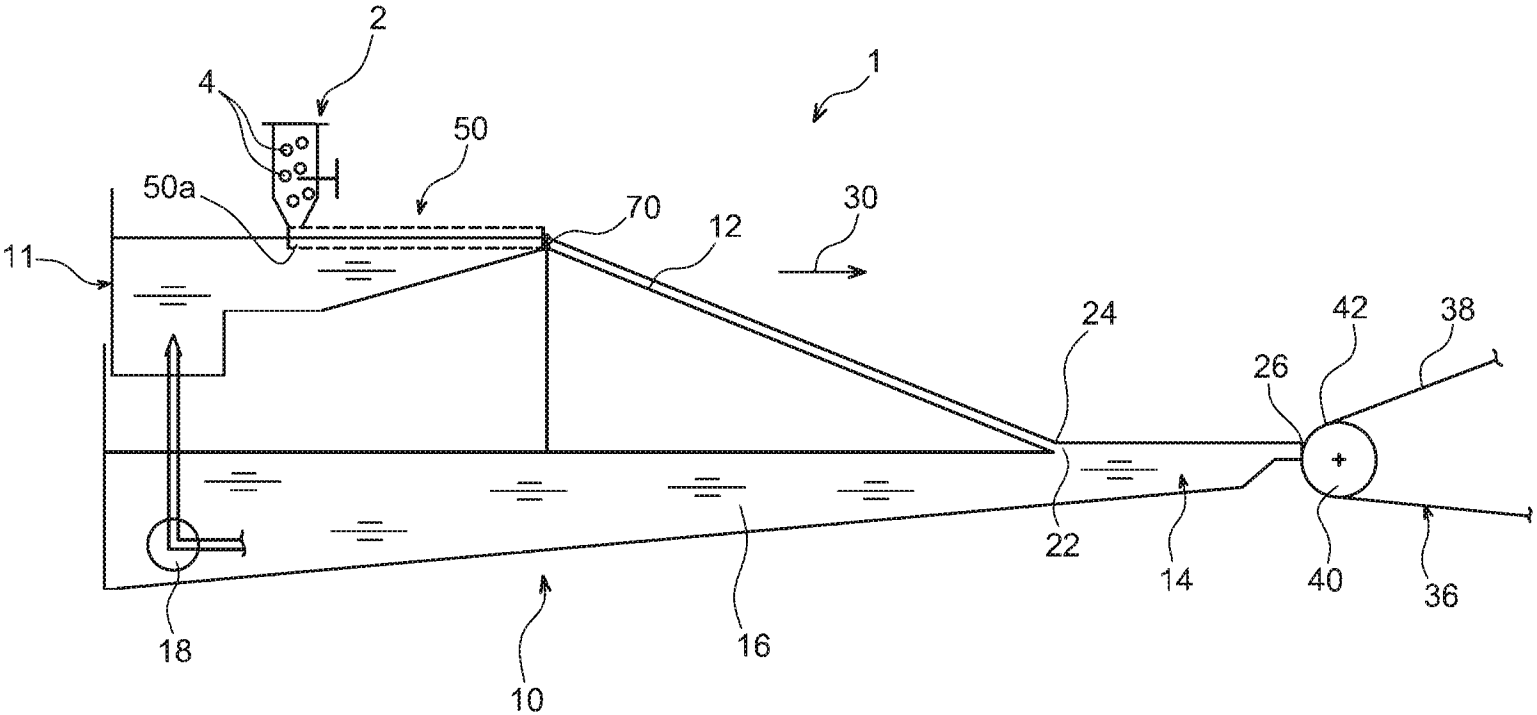
FIG. 1 shows an installation according to a preferred embodiment of the present invention, in a schematic section along the line I-I in FIG. 2.
Figure 2:
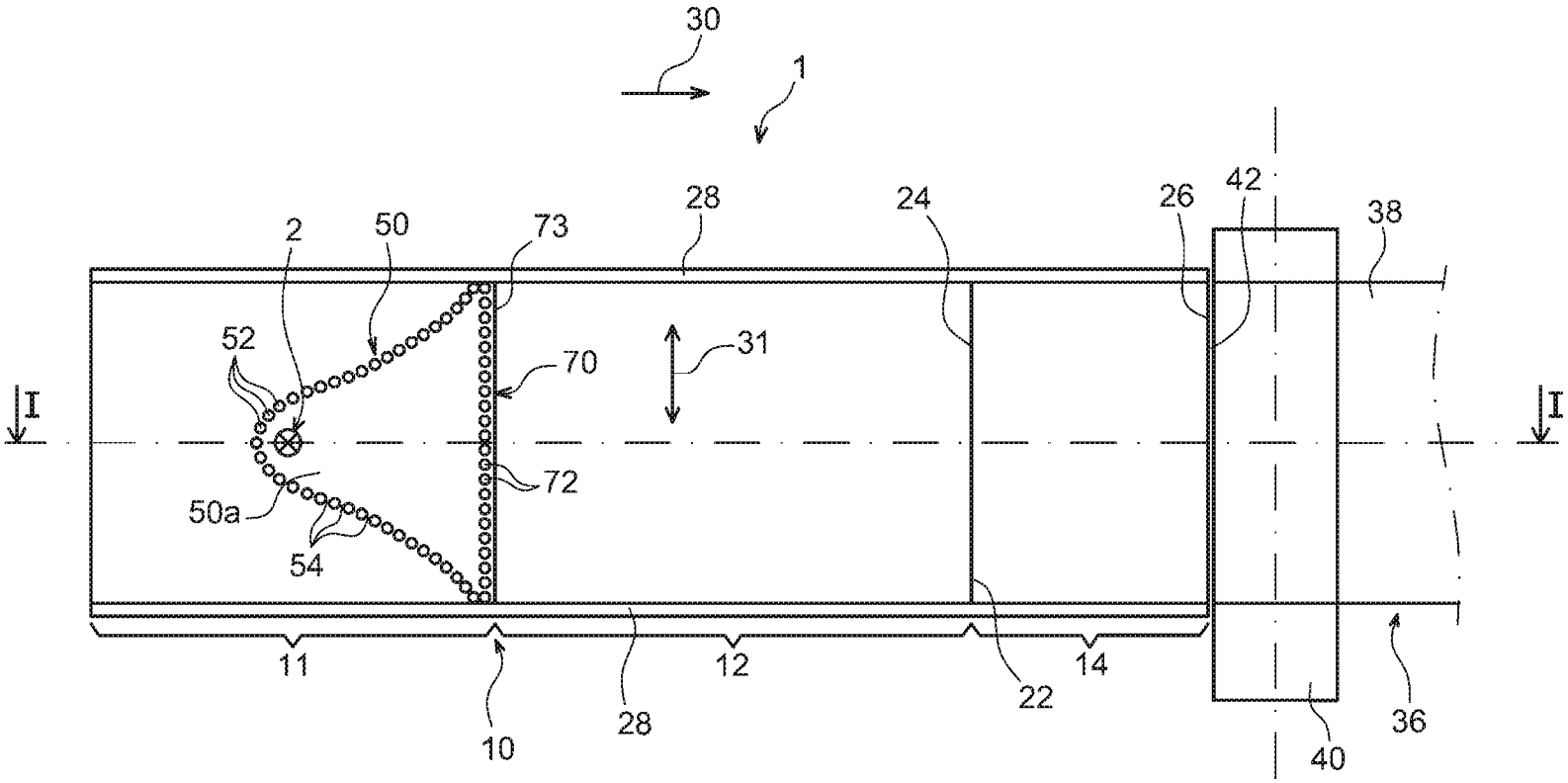
FIG. 2 represents a schematic top view of the installation shown in FIG. 1.

With reference firstly to FIGS. 1 and 2, an installation 1 for forming a compact film of particles and transferring same onto substrate, which is preferably conveyed, is represented.

The installation 1 includes means 2 for dispensing the particles 4 in solution. These particles have a size which may be between a few nanometers and several hundred micrometers. The particles, preferably spherical in shape, may for example be silica particles. Further particles of interest may be made of metal or metal oxide such as Platinum, $TiO_2$, of polymer such as polystyrene or PMMA, of carbon, etc.

More specifically, in the preferred embodiment, the particles are silica spheres between 1 nm and 500 μm in diameter, and more preferentially of the order of 1 μm. These particles 4 are stored in solution in the means 2. The proportion of the medium is approximately 7 g of particles per 200 ml of solution, in this case such as butanol or chloroform. Naturally, for the purpose of clarity, the particles 4 have been represented with a diameter greater than the actual diameter thereof.

The dispensing means 2 having a controllable injection nozzle, approximately 500 μm in diameter.

The installation also includes a fluid conveyor 10, receiving a carrier fluid 16 whereon the particles 4 are intended to float. The conveyor 10 incorporates a zone acting as a reservoir 11, an inclined ramp 12 for particle circulation, and a particle storage and transfer zone 14. The ramp 12 is situated extending from the reservoir 11, i.e. the inlet thereof is substantially merged with the outlet of the reservoir. The storage and transfer zone 14 is for its part situated extending from the inclined ramp, i.e. the inlet thereof is substantially merged with the outlet of the ramp, whereon the particles are intended to circulate gravitationally. In addition, the inclined ramp 12 creates a separation in the level between the reservoir 11 and the storage and transfer zone 14. The latter has a substantially horizontal bottom, or a slight inclination so as to favour draining of the installation, if required.

The upper end of the inclined ramp 12 is provided to receive the particles from the reservoir 11, previously injected by the dispensing means 2. This ramp is straight, inclined by an angle between 5 and 60°, preferably between 10 and 30°, enabling the particles to be conveyed to the zone 14. Furthermore, the carrier fluid 16 circulates on this ramp 12, up to the storage and transfer zone 14. This fluid 16 is further moved by suitable means, for example a pump 18. This recirculation pump 18 thus ensures movement of the fluid 16 so as to make same circulate from the reservoir 11 to the storage and transfer zone 14, via the inclined ramp 12. Nevertheless, it may alternatively be envisaged to circulate a new fluid, via an open circuit.

The carrier fluid 16 is preferably deionised water, whereon the particles 4 can float. It may also consist of an association of a plurality of non-miscible fluids. As a reminder, solvents such as chloroform or n-butanol have surface tensions of the order of 26.67 and 24.93 mN/m at 25° C., respectively, whereas deionised water has a surface tension of the order of 72 mN/m. The interfacial tension gradients resulting from these differences in values induce hydrodynamic instabilities, which are manifested as convection movements also known as Marangoni instabilities. The effects of these convection movements are attenuated by means specific to the invention, which will be described hereinafter.

Back to the conveyor 10, it is noted that the lower end of the ramp 12 is connected to an inlet of the particle storage and transfer zone 14. This inlet 22 is situated at an inflection line 24 representing the junction between the surface of the carrier fluid present on the inclined plane of the ramp 12, and the surface of the carrier fluid present on the horizontal portion of the zone 14.

The particle inlet 22 is spaced from a particle outlet 26 using two lateral edges 28 retaining the carrier fluid 16 in the zone 14. These edges 28, facing and at a distance from one another, extend parallel with a main flow direction of the carrier fluid and the particles in the installation, this direction being represented schematically by the arrow 30 in FIGS. 1 and 2. The edges 28 extend preferably along the entire length of the conveyor 10, from the reservoir 11 to the zone 14. They are spaced along a transverse direction 31 of the installation, parallel with the surface of the fluid 16 and orthogonal to the main flow direction 30.

The three elements 11, 12, 14 of the conveyor 10 thus each have the shape of a corridor or a path open at the inlet and outlet thereof, although further geometries could be adopted, without leaving the scope of the invention.

The bottom of the downstream portion of the zone 14 has a slightly inclined platform in the upstream direction with respect to the horizontal direction, for example by a value of the order of 5 to 10°. The downstream end of said platform, also known as a "blade", partially defines the outlet of the particles 26.

The installation 1 is also provided with a substrate conveyor 36, intended to convey the substrate 38. This substrate may be rigid or flexible. In the latter case, it may be moved on a roller 40 the axis whereof is parallel with the outlet 26 of the zone 14, in the vicinity whereof it is situated. Indeed, the substrate 38 is intended to be conveyed very close to the outlet 26, so that the particles reaching this outlet can be transferred easily onto this substrate, via a capillary bridge 42, also known as a meniscus, linking same to the carrier fluid 16. The capillary bridge 42 is provided between the carrier fluid 16 which is situated at the outlet 26, and a portion of the substrate 38 moulding the guide/drive roller 40. Alternatively, the substrate may be in contact directly with the transfer zone, without leaving the scope of the invention. The capillary bridge mentioned above is then no longer required.

By way of information, in the case where the substrate is rigid and the objects to be transferred are also rigid and cannot be adapted to an angle break during transfer, it may be advantageous to immerse the substrate in the fluid of the storage and transfer zone 14, and perform pulling in this configuration. This makes it possible maximise the angle formed between the horizontal plane of the fluid of the zone 14, and the plane of the substrate.

In the example shown in the figures, the width of the substrate corresponds to the width of the zone 14 and the outlet 26 thereof. This width also corresponds to the maximum width of the film of particles that can be deposited onto the substrate. This width may be of the order of 25 to 30 cm. The width of the substrate whereon the particles are to be deposited may however be less than the width of the zone 14.

The installation 1 also includes a structure 50 for deflecting particles 4, this structure being arranged at the reservoir 11, downstream from the dispensing means 2 along the main flow direction 30.

The deflection structure 50 passes through the surface of the carrier fluid 16. It is configured to favour, along the transverse direction 31, spreading of the particles 4 at the outlet of the reservoir 11. For this purpose, the structure 50 extends all along the carrier fluid along the transverse direction 31, between a first and a second end opposite along said direction 31. It has a general shape defining at least one convex portion **50*a* viewed from an outlet of the reservoir, the dispensing means 2 being arranged immediately downstream from this convex portion. As seen more clearly in FIG. 2, the structure 50 has a parabolic general shape, with the convex portion 50*a* corresponding to the apex thereof. In addition, from this apex, the parabolic structure 50 extends downstream and towards the edges 28 up to the vicinity of the outlet of the reservoir, which makes it possible to spread the particles 4 along the direction 31 before they reach the inclined ramp 12. At the outlet of the reservoir 11 feeding the ramp 12, without this structure 50, the density of the particles 4 would be greater at the centre than on the edges of this reservoir 11**.

Figure 3:
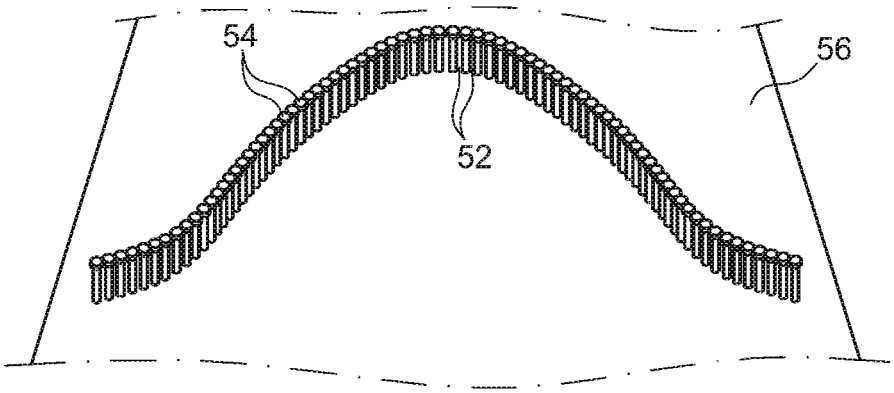
FIG. 3 represents a perspective view of an example of an embodiment of the structure for deflecting the particles, fitted in the installation shown in the preceding figures.
Figure 4:
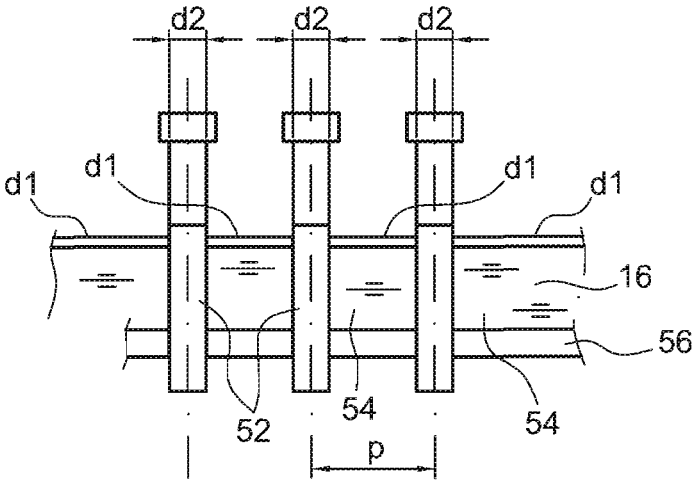
FIG. 4 shows an enlarged front view of a portion of the structure represented in the preceding figure.

One of the specificities of the invention lies in that the deflecting structure 50 is permeable to the carrier fluid. This function is carried out by an alternation, between the first and second ends thereof, of obstacles 52 and spaces 54 separating these obstacles. FIGS. 3 and 4 show an example of an embodiment wherein the obstacles 52 are screw rods screwed onto a support plate 56, resting for example in the bottom of the reservoir. This plate 56 is thus perforated with holes each receiving a screw 52, these holes being created along an imaginary line of parabolic shape, corresponding to that sought for the structure 50.

The obstacles 52 are fitted with an interval "p" of approximately 5 mm. Furthermore, the deflecting structure 50 is embodied so as to present, at the surface of the fluid 16, an open area ratio of approximately 0.5. This open area ratio corresponds to the ratio between the sum of the lengths "d1" of the spaces 54, and the sum of the lengths "d1" and the lengths "d2" of the screw rods 52 corresponding to the diameter thereof, for example of the order of 3 mm.

The screw rods 52 and the support plate 56 are preferentially made of hydrophobic material, for example, polymer material.

In addition, when the fluid 16 is moved in the reservoir 11 towards the ramp 12, it passes through the spaces 54 and abuts against the screw rods 52, so as to spread and impede the Marangoni instabilities. The risks of dewetting of the ramp 12 are thus considerably reduced, even when the surface tensions differ considerably between the carrier fluid and the solution incorporating the particles.

Figure 5:
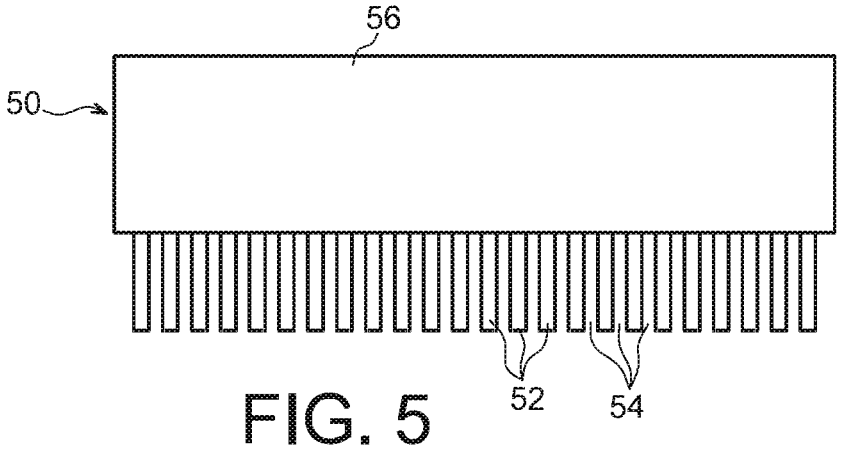
FIG. 5 represents a schematic front view of a further example of an embodiment of the structure for deflecting the particles, fitted in the installation shown in the preceding figures.

According to one alternative embodiment shown in FIG. 5, the obstacles 52 could be connected to an upper supporting member 56, similar to a comb. The supporting member 56 would then no longer be immersed in the carrier fluid traversed by the rods 52, but situated above this fluid by being for example connected to the edges 28 of the conveyor.

Figure 6:
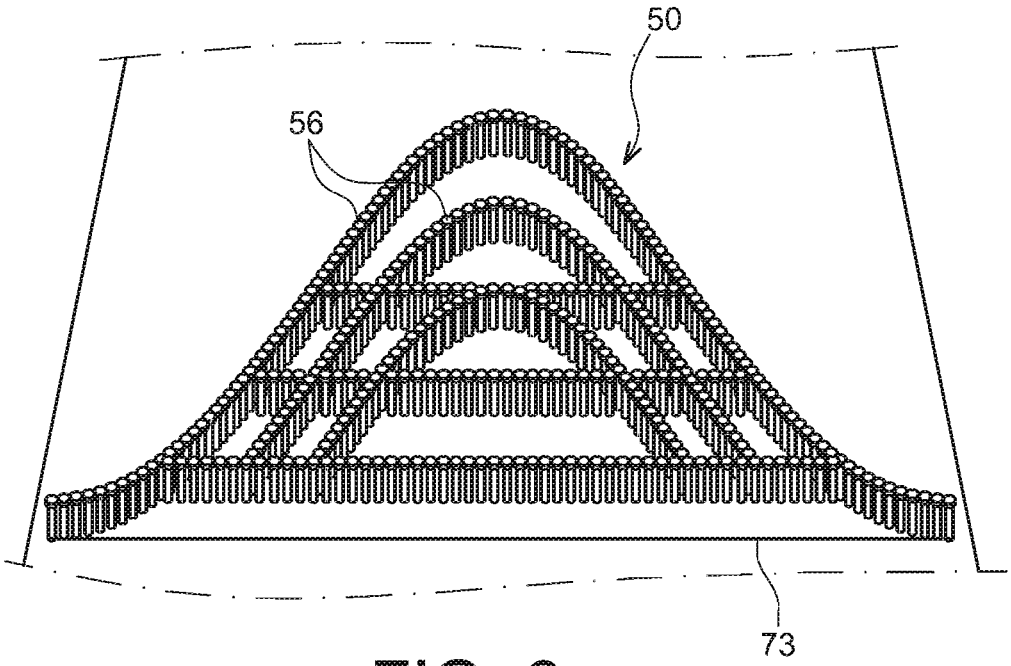
FIG. 6 is a similar view to that in FIG. 3, with the zone acting as a reservoir embodied in a multi-compartmentalised fashion.
Figure 7:
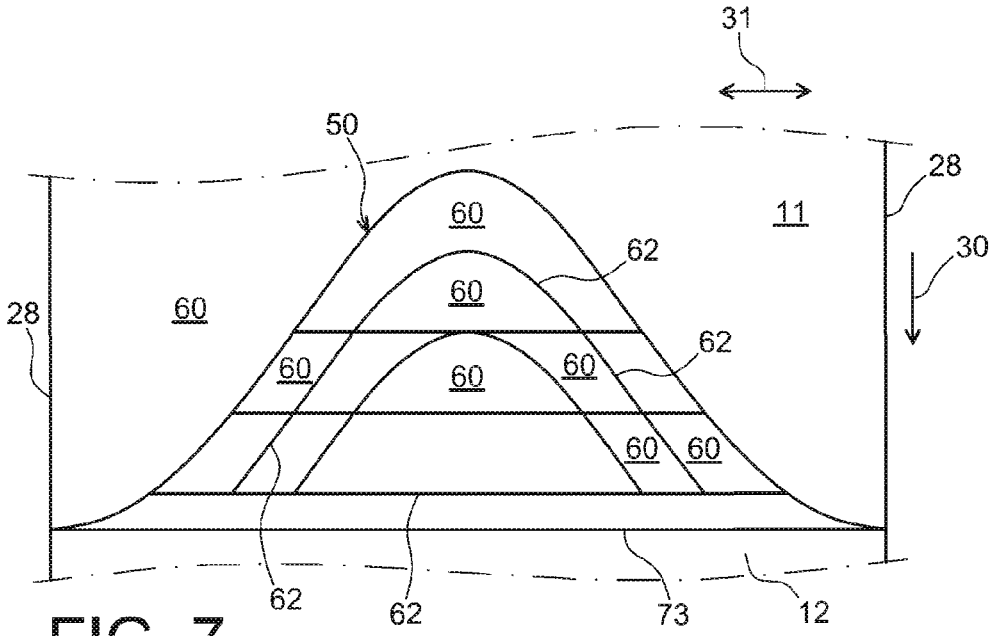
FIG. 7 is a top view of that shown in FIG. 6.

Regardless of the solution selected, it may be supplemented by the embodiment, in the reservoir 11 downstream from the deflecting structure 50, of at least one compartment 60 defined by a wall 62 permeable to the carrier fluid 16. Such an arrangement is represented in FIGS. 6 and 7, wherein the reservoir 11 is multi-compartmentalised downstream from the deflecting structure 50.

The walls 62, which also pass through the surface of the fluid 16, make it possible to impede the propagation of the hydrodynamic instabilities even further. These permeable walls 62 are embodied in a manner substantially identical or similar to the structure 50, i.e. by obstacles and spaces allowing the passage of the carrier fluid. In addition, all the features described for the structure 50 are applicable to the walls 62 defining the compartments 60, the surface area whereof on the surface of the fluid 16 may be between 2 and 500 $cm^2$. In particular, the wall 62 may be embodied by screw rods passing through the surface of the carrier fluid, and screwed into corresponding screws created via the support plate 56 also bearing the deflecting structure 50.

The shape of the compartments 60 may vary. In the example represented, some walls 62, defining a plurality of compartments, have a parabolic shape substantially homothetic in respect of that of the deflecting structure 50.

The walls 62 being arranged downstream from the means 2 for dispensing the particles 4, these may hence be brought to pass through these walls 62 before reaching the inlet of the ramp 12.

It is noted that the instabilities and particles may pass through the structure 50 from downstream to upstream. This is a temporary phenomenon since the flow of carrier fluid pushes the whole back to the inclined plane, downstream. The advantage of such a situation is that of also benefiting from the upstream structure 50 to deconfine the instabilities further. Furthermore, the profile of the structure 50, for example parabolic, circular, V-shaped, sinusoidal, etc., distorts the flow lines on the surface to favour spreading of the particles and instabilities over the width 31.

A further specificity of the invention lies in that it envisages, arranged at a junction 73 between the reservoir 11 and the inclined ramp 12, means 70 for raising the level of the fluid 16 by a capillary effect. It is noted that this junction 73 between the reservoir 11 and the ramp 12 is situated at an inflection point of the fluid between these two elements of the conveyor 10.

Figure 8:
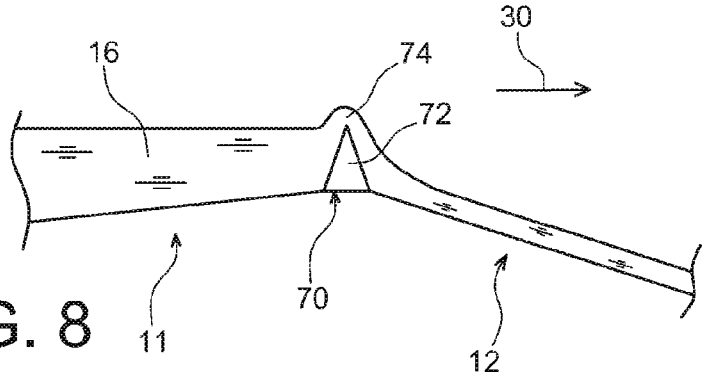
FIG. 8 is an enlarged side view showing the barrier of spaced contacts fitted in the installation shown in FIGS. 1 and 2.
Figure 9:
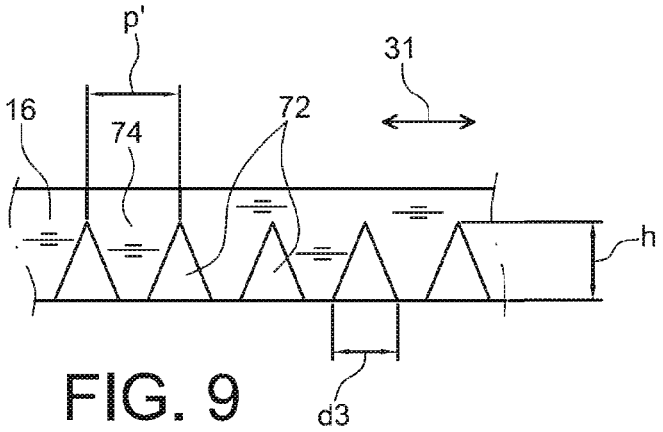
FIG. 9 is a front view of that shown in FIG. 8.
Figure 10A:
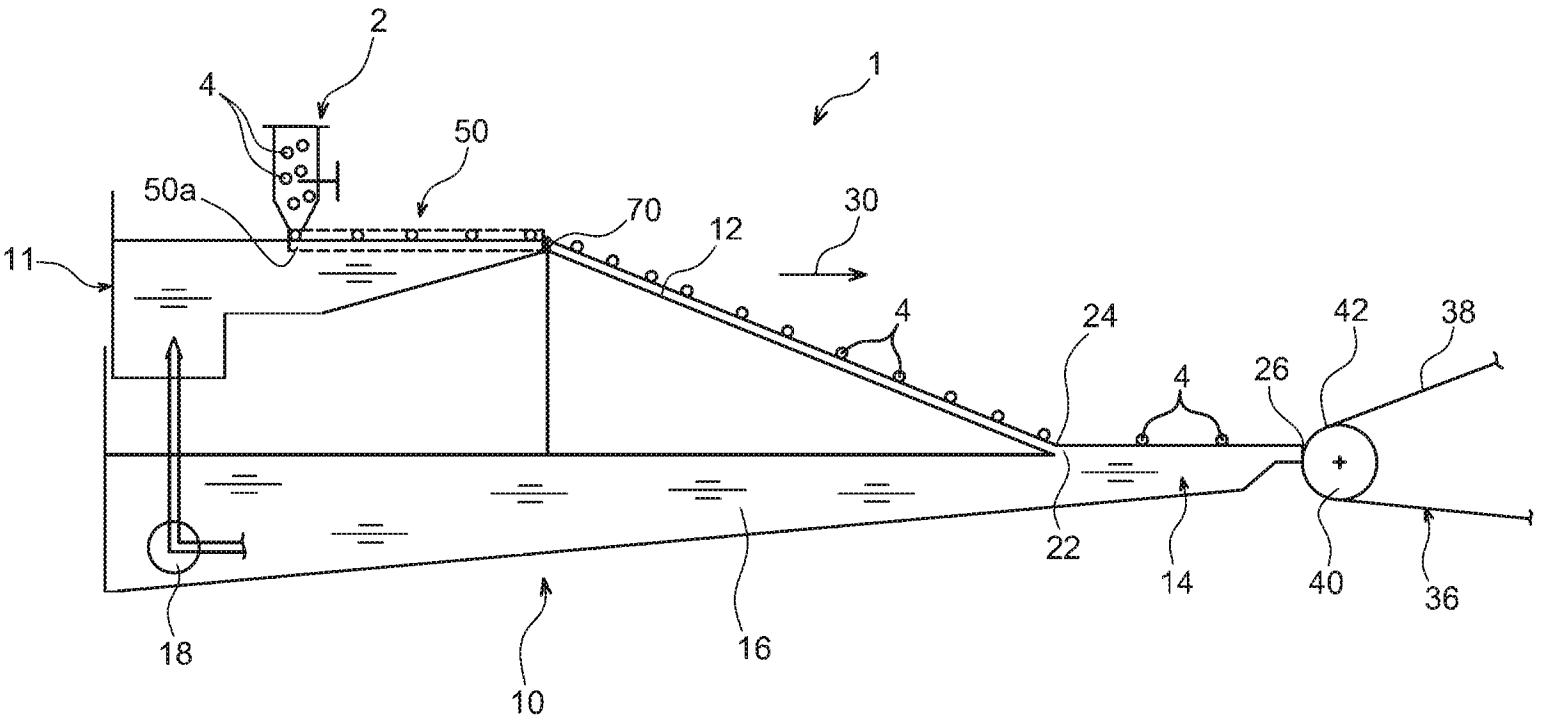
FIGS. 10*a* to 11*b* represent schematically different steps of a method for forming and depositing a compact film of particles according to one preferred embodiment of the invention, implemented using the installation shown in the preceding figures.
Figure 10B:
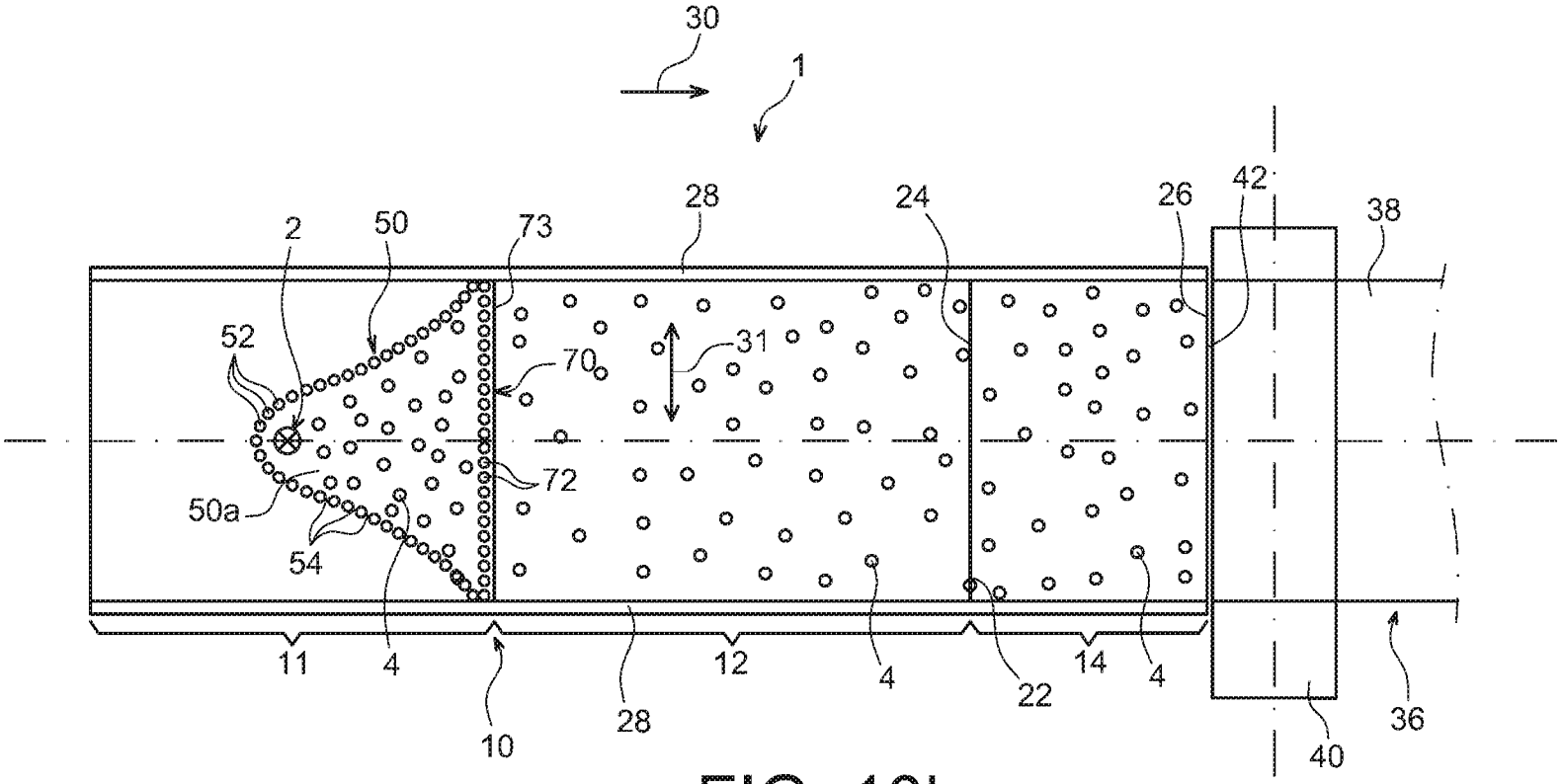

These means 70, preferably embodied by a transverse barrier of contacts 72 spaced from one another, locally raise the level of carrier fluid 16, immediately before the entry thereof onto the inclined ramp 12. This barrier is represented in more detail in FIGS. 8 and 9. Indeed, the constituent blocks 72 thereof enable the creation of a transverse bulge of fluid 74 at the junction between the reservoir 11 and the ramp 12, by means of a capillary effect compensating for the weight of this carrier fluid. This technique, intended to create the bulge 74 protruding upwards, makes it possible to reduce the fluid thickness variation phenomenon further, resulting from the interfacial tension gradients between this fluid 16 and the solution including the particles 4. The risks of dewetting the ramp 12 are thus reduced further by the use of this arrangement.

The contacts 72 are arranged along the entire width of the reservoir 11, along the direction 31. They are fitted with an interval "p'" of approximately 2 to 4 mm. The contacts have a conical overall shape, with the base situated at the bottom, having a width/diameter "d3" of approximately 2 mm, and a height "h" between 2 and 3 mm. These contacts are made of hydrophobic material, for example silicone.

A method for forming and depositing a compact film of particles according to one preferred embodiment of the invention will now be described with reference to FIGS. 10*a* to 11*b*.

Firstly, the injection nozzle 6 is activated to start dispensing the particles 4 into the reservoir 11. This involves implementing an initial step for filling the storage and transfer zone 14, by the particles 4, with the carrier fluid 16 already at the required level in the zone 14. This step is represented schematically in FIGS. 10*a* and 10*b*.

During this activation phase, the dispensed particles 4 are guided by the structure 50 and pass through the compartments when said compartments are provided in the reservoir 11, before reaching the ramp 12. The particles 4 then enter the zone 14 wherein they are dispersed.

As the particles 4 are injected and enter the storage and transfer zone 14, they abut against the substrate 38, then the upstream leading edge of these particles tends to be shifted upstream, towards the inflection line 24. The injection of particles is continued even after this upstream leading edge has exceeded the line 24, so that they move up on the inclined ramp 12.

Figure 11A:
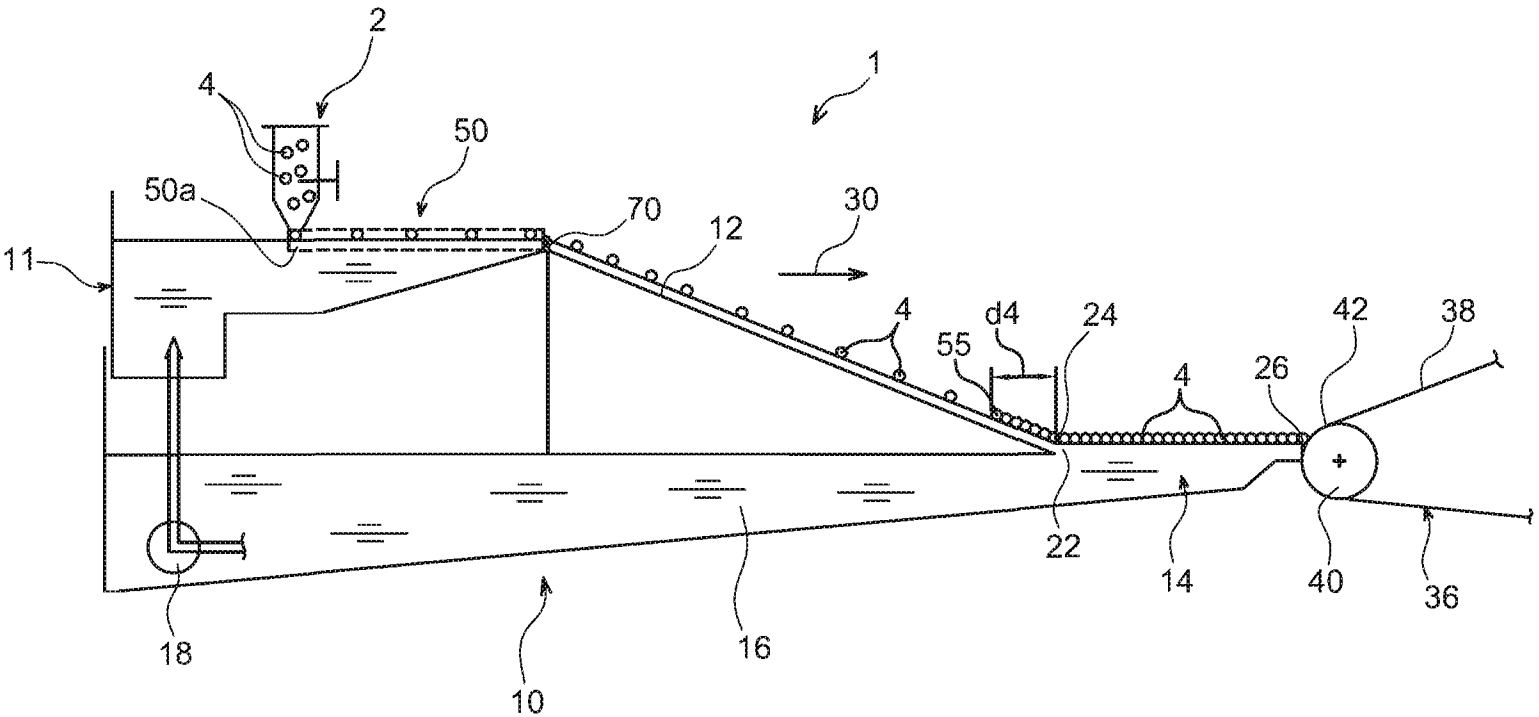

Indeed, it is ensured that the upstream leading edge of particles 55 moves up on the ramp 12 such that it is situated at a given horizontal distance "d4" from the inflection line 24, as shown in FIG. 11*a*. The distance "d4" may be of the order of 30 mm.

Figure 11B:
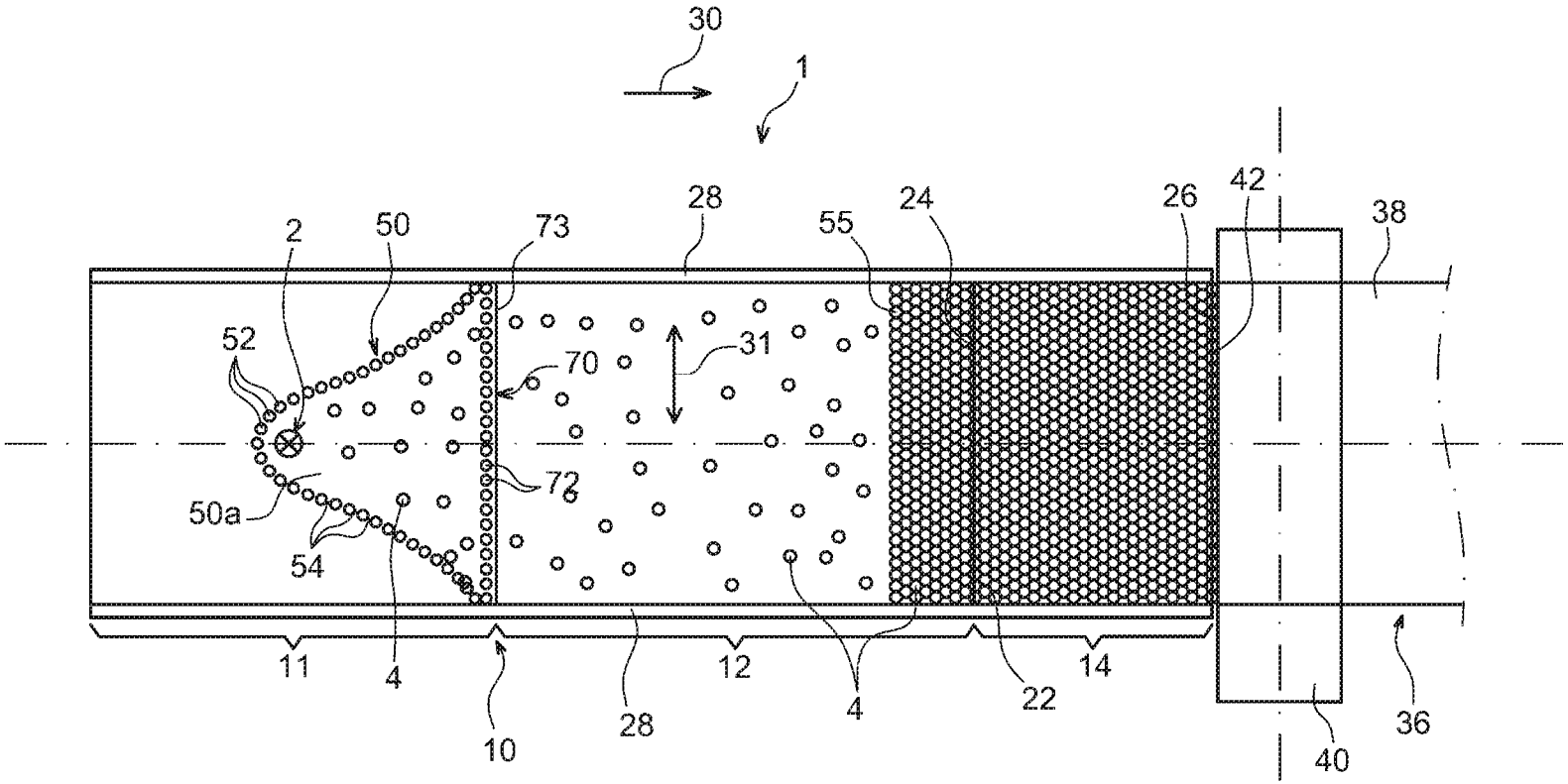

At this time represented in FIGS. 11*a* and 11*b*, the particles 4 are organised in the zone 14 and on the ramp 12, whereon they are organised automatically, without assistance, notably due to the kinetic energy thereof and the capillary forces used at the time of impact on the leading edge 55. The organisation is such that the first compact film obtained has a so-called "compact hexagonal" structure in the case of spheres, wherein each particle 4 is surrounded and contacted by six other particles 4 in contact with one another. The terms compact film of particles or film of organised particles are then used equally.

Once the organised particles 4 forming the film cover all the carrier fluid situated in the zone 14, a step for structuring this film may be carried out, which will not be detailed herein, but which is known to those skilled in the art. It consists for example of positioning objects on the compact film.

Then, the movement of the substrate 38 is carried out, initiated once the leading edge 55 has reached the required level represented in FIG. 11*a*, and after any structuring process mentioned above. Alternatively, the structuring could be carried out after the deposition of the film on the substrate, without leaving the scope of the invention.

When the substrate 38 starts to be conveyed, the film of particles 4 is deposited thereon while passing via the outlet 26 and taking the capillary bridge 42, similar to the that described in the document CA 2 695 449. A solution using contact rather than using a capillary bridge can also be envisaged, without leaving the scope of the invention.

To facilitate the deposition and adherence of the particles 4 on the substrate 38, preferably made of polymer, thermal annealing after the transfer is envisaged. This thermal annealing is for example carried out at 80° C., using a polyester-based low-temperature matt laminating film, for example marketed under the reference PERFEX-MATT™, 125 μm in thickness.

The advantage of such a film as a substrate is that one of the faces thereof becomes adhesive at the temperature of the order of 80° C., which makes it possible to facilitate the adherence of the particles 4 thereon. More specifically, at this temperature, the particles 4 sink into the softened film 38, and thus enable direct contact with the film, resulting in the bonding thereof.

Alternatively, the substrate 38 may of the silicon, glass, or piezoelectric film type.

During the formation of the film and the transfer, the injection of particles and the conveyance speed of the substrate are set such that the leading edge of particles remains in a substantially identical position. For this purpose, the flow rate of particles may be of the order of 0.1 ml/min to several ml/min, whereas the linear speed of the substrate 38, also known as the pull rate, may be of the order of 0.1 cm/min to 100 cm/min. This high pull rate, which may be greater by more than 30% with respect to the possible maximum speeds with the installations according to the prior art, is obtained in particularly by means of the circulation of the carrier fluid via the permeable deflecting structure 50, and by means of the creation, by the capillary effect, of the bulge of fluid before the introduction thereof onto the inclined ramp 12.

Obviously, various modifications may be made by those skilled in the art to the invention described above, merely by way of non-limiting examples.

The invention claimed is:

1. An installation for forming a compact film of particles on a surface of a carrier fluid, the installation comprising:

a zone acting as a carrier fluid reservoir;

an inclined ramp situated extending from the zone acting as a reservoir and whereon the particles can circulate gravitationally;

a particle storage and transfer zone situated extending from the inclined ramp;

means for moving the carrier fluid intended to make the carrier fluid circulate from the zone acting as a reservoir to the particle storage and transfer zone, via the inclined ramp;

means for dispensing the particles in solution, configured to dispense the particles on the surface of the carrier fluid in the zone acting as a reservoir; and a structure for deflecting particles, passing through the surface of the carrier fluid into the zone acting as a reservoir, the structure positioned downstream from the means for dispensing particles along a main flow direction of the carrier fluid from the zone acting as a reservoir to the particle storage and transfer zone, via the inclined ramp, the structure configured to favor, along a transverse direction of the installation parallel with the surface of the carrier fluid and orthogonal to a main flow direction, spreading of the particles at an outlet of the zone acting as a reservoir;

wherein the structure for deflecting particles is permeable to the carrier fluid.

2. An installation according to claim 1, wherein the structure for deflecting particles includes, in alternation, between a first end and a second opposite end in the transverse direction, obstacles and spaces allowing passage of the carrier fluid.

3. An installation according to claim 2, wherein the obstacles are rods, or screw rods screwed onto a support plate.

4. An installation according to claim 2, wherein the obstacles are fitted with an interval of approximately 1 to 10 mm, and the structure for deflecting particles has, on the surface of the carrier fluid, an open area ratio of 0.05 to 0.9.

5. An installation according to claim 2, wherein the obstacles are made of hydrophobic material, polymer, hydrophilic material, or metallic material.

6. An installation according to claim 2, wherein the obstacles have a width between 1 and 9.5 mm.

7. An installation according to claim 1, wherein the structure for deflecting particles extends all along the carrier fluid, along the transverse direction of the installation.

8. An installation according to claim 1, wherein the structure for deflecting particles has an overall shape defining at least one convex portion viewed from the outlet of the zone acting as a reservoir.

9. An installation according to claim 8, wherein the structure for deflecting particles has a parabolic, circular, V-shaped, or sinusoidal overall shape.

10. An installation according to claim 1, wherein the zone acting as a reservoir includes, downstream from the structure for deflecting particles, at least one compartment defined by a wall permeable to the carrier fluid, a surface whereof is traversed by the wall.

11. An installation according to claim 10, wherein the wall is embodied by alternating obstacles and spaces allowing the passage of the carrier fluid.

12. An installation according to claim 10, wherein each compartment has, on the surface of the carrier fluid, a surface area between 0.5 and 1000 $cm^2$.

13. An installation according to claim 1, further comprising a substrate for depositing the compact film of particles, the substrate facing an outlet of particles from the storage and transfer zone.

14. An installation according to claim 13, configured to carry out deposition of the compact film of particles on a conveyed substrate, the substrate being flexible or rigid.

15. An installation according to claim 1, further comprising, arranged at a junction between the zone acting as a reservoir and the inclined ramp, means for raising a level of the carrier fluid by capillary effect.

16. A method for forming a compact film of particles on a surface of a carrier fluid, using an installation according to claim 1, comprising moving the carrier fluid to make the carrier fluid circulate from the zone acting as a reservoir to the particle storage and transfer zone, via the inclined ramp, and dispensing the particles in solution on the surface of the moving carrier fluid, in the zone acting as a reservoir, the moving the carrier fluid being carried out to make the carrier fluid circulate through the permeable structure for deflecting particles, arranged upstream from the means for dispensing the particles.

17. A method according to claim 16, used for forming a film of particles having a size between 1 nm and 500 μm.

18. A method according to claim 16, wherein the carrier fluid is deionized water, and the particles are found in solution in a solvent having a surface tension less than that of deionized water.

19. A method according to claim 18, wherein the solvent is n-butanol, methanol, chloroform, or a mixture of at least two thereof.

* * * * *